US006606893B2

(12) United States Patent
Hamm et al.

(10) Patent No.: US 6,606,893 B2
(45) Date of Patent: Aug. 19, 2003

(54) ROLL GROOVING APPARATUS

(75) Inventors: James E. Hamm, Grafton, OH (US); Randy Scott Wise, Burton, OH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/298,865

(22) Filed: Nov. 19, 2002

(65) Prior Publication Data

US 2003/0061851 A1 Apr. 3, 2003

Related U.S. Application Data

(62) Division of application No. 09/905,388, filed on Jul. 13, 2001.

(51) Int. Cl.[7] ..... B21D 15/04
(52) U.S. Cl. ..... 72/105; 72/101; 72/121
(58) Field of Search ..... 72/101, 105, 106, 72/120, 121

(56) References Cited

U.S. PATENT DOCUMENTS

| | | | | |
|---|---|---|---|---|
| 2,325,827 A | * | 8/1943 | Berlichingen et al. | 72/121 |
| 2,975,819 A | | 3/1961 | Costanzo et al. | |
| 3,015,502 A | | 1/1962 | Frost et al. | |
| 3,754,424 A | | 8/1973 | Costanzo | |
| 3,995,466 A | | 12/1976 | Kunsman | |
| 4,041,747 A | | 8/1977 | Elkin | |
| 4,114,414 A | | 9/1978 | Goodman | |
| 4,144,733 A | | 3/1979 | Whitten | |
| 4,389,867 A | * | 6/1983 | Whitlock | 72/121 |
| 4,848,121 A | * | 7/1989 | Rottinghaus | 72/121 |
| 4,930,326 A | * | 6/1990 | Rottinghaus | 72/121 |
| 5,079,940 A | | 1/1992 | Pulver et al. | |
| 5,246,256 A | | 9/1993 | Rung et al. | |
| 5,279,143 A | | 1/1994 | Dole | |
| 5,528,919 A | | 6/1996 | McGrady et al. | |
| 5,570,603 A | | 11/1996 | Chatterley et al. | |
| 6,244,088 B1 | | 6/2001 | Compton | |
| 6,272,895 B1 | * | 8/2001 | Hamm | 72/105 |

OTHER PUBLICATIONS

Undated catalog sheet of Reed Manufacturing Company; "Reed RG26S Roll Groover #08510"; 1 page.
Undated parts list of Reed Manufacturing Company; "Reed RG26S Roll Groover #08510"; 1 page.
Undated 10 page manual of Reed Manufacturing Company; "RG26S Operator's Manual".
Undated 10 page manual of the Victaulic Company of America; "Victaulic VE–26S and VE–26C Operating Instructions".

* cited by examiner

*Primary Examiner*—Ed Tolan
(74) *Attorney, Agent, or Firm*—Fay, Sharpe, Fagan, Minnich & McKee

(57) ABSTRACT

Apparatus for roll grooving thin wall pipe comprises a housing supporting a drive roll and an arm pivotally mounted on the housing and supporting a grooving roll. A feed screw between the housing and arm provides for pivoting the arm to displace the grooving roll radially toward and away from the drive roll, and a release arrangement between the feed screw and arm is operable to release the arm from the screw to protect the screw from damage. The feed screw is mounted on the housing and arm by a double pivot arrangement. Self-tracking during a roll grooving operation is provided by dimensionally different knurling on axially opposite sides of the rolling groove of the drive roll and/or by inclining the axis of the grooving roll relative to the axis of the drive roll and/or by tapering the rolling surface on the rolling projection of the grooving roll and/or by supporting the axially outer end of the drive roll against deflection.

23 Claims, 8 Drawing Sheets

ROLL GROOVING APPARATUS

This patent application is a division of application Ser. No. 09/905,388 filed on Jul. 13, 2001, and incorporated herein by reference.

BACKGROUND OF THE INVENTION

This invention relates to the art of roll grooving apparatus and, more particularly, to improvements in such apparatus relating to obtaining and maintaining a desired alignment between grooving rolls and a workpiece and thus obtaining and maintaining tracking between the grooving rolls and workpiece so that the rolled groove is transverse to the workpiece axis.

The present invention finds particular utility in conjunction with a portable roll groover which is adapted to be interengaged with a rigidly supported pipe so as to travel about the periphery of the pipe during the roll grooving operation. Accordingly, while the invention will be illustrated and described herein in conjunction with such a roll groover, it will be understood and appreciated that the invention is applicable to roll grooving apparatus of the character wherein the roll groover is rigidly supported and the pipe to be grooved rotates relative thereto during the grooving operation.

Roll grooving apparatus is well known and generally includes a pair of relatively displaceable housing components or support members which respectively rotatably support a drive or back-up roll and an idler or grooving roll between which a pipe to be grooved is interposed during a grooving operation. The two rolls are matingly contoured and, in this respect, the drive roll is provided with a peripheral groove and the grooving roll is provided with a peripheral projection such that a pipe therebetween is provided with a peripheral groove upon relative rotation of the grooving rolls and relative radial displacement of the rolls toward one another. The drive roll is rotated by a hand tool or by a drive motor depending on the particular type of roll grooving apparatus.

Often, relative displacement between the roll supports is achieved through the use of threaded feed screw arrangements between the supports and which include a screw component which is manually rotated either by hand or by a tool such as a wrench. The roll supports are interengaged for linear or pivotal displacement toward and away from one another and, in either instance, the feed screw is rotated in the direction to separate the rolls to facilitate the insertion of the end of a tube or pipe therebetween, and the feed screw is then rotated in the opposite direction to bring the grooving rolls into engagement with the pipe. The pipe, back-up roll and grooving roll are then relatively rotated, and the feed screw is manually rotated in the direction to displace the grooving roll toward the back-up roll to progressively form a peripheral groove in the pipe. When the desired groove diameter is reached, relative rotation is stopped and the feed screw is rotated in the opposite direction until there is sufficient clearance between the two rolls to accommodate removal of the grooved pipe therefrom.

It is well known that it is necessary for the pipe and grooving roll axes to be properly aligned during a roll grooving operation so that the track of the groove is transverse to the pipe axis. Misalignment at the beginning of the roll grooving operation can cause the track of the groove to spiral relative to the pipe axis, whereupon the pipe or the tool "walks " in the direction to axially separate the rolls and pipe. The tracking problem is attendant to the operation of any roll grooving apparatus including those in which the roll supports are relatively displaced other than by a feed screw and, for example, hydraulically as shown in U.S. Pat. No. 3,995,466 to Kunsmann, and manually through a pivotal lever arm as disclosed in U.S. Pat. No. 5,079,940 to Pulver, et al. Numerous efforts have been made to provide roll grooving apparatus with a self-tracking feature, and these efforts have included providing the back-up or drive roll with teeth on an outer surface thereof which urge the pipe and grooving rolls axially inwardly relative to one another as disclosed in U.S. Pat. No. 5,528,919 to McGrady, et al. Other efforts have included supporting the pipe to be roll grooved at an angle to the axes of the grooving rolls as disclosed in the aforementioned patent to Kunsmann, and by inclining the axis of the idler or grooving roll relative to the axis of the back-up roll as disclosed in U.S. Pat. No. 4,041,747 to Elkin and in U.S. Pat. No. 2,975,819 to Costanzo, et al. Still further efforts have included contouring the outer surface of the back-up or drive roll in the form of a frustum of a cone as disclosed in U.S. Pat. No. 5,279,143 to Dole, and by providing an auxiliary roller for engaging the outer surface of a pipe being grooved and having its axis inclined relative to that of a pipe being grooved as disclosed in the aforementioned patent to Costanzo, et al.

While all of the foregoing arrangements promote self-tracking, they add undesirably to the expense of the roll grooving apparatus by requiring additional and/or specially designed component parts for the apparatus, thus adding to the cost of maintaining the apparatus as well as the cost of manufacturing the same. Furthermore, in those devices using a feed screw for displacing the grooving rolls relative to one another, feed screw wear is often a problem as is the potential of jamming and a higher than desired input torque requirement. Moreover, there is a potential for damaging the feed screw through dropping of the roll grooving apparatus which is a common occurrence in the field. Still further, the forces required to groove thick wall pipe, such as 5 inch Sch. 40 pipe, cause the axis of the back-up or drive roll to deflect and thus adversely affect efforts to maintain proper tracking. Therefore, it has not been possible heretofore to roll groove a full range of pipe sizes from, for example, 1¼ inch to 12 inch, using just one basic grooving unit.

SUMMARY OF THE INVENTION

In accordance with the present invention, improvements are provided in roll grooving apparatus which minimize or overcome the foregoing and other problems encountered in connection with the structure and operation of roll grooving apparatus heretofore available. In accordance with one aspect of the invention, roll grooving apparatus of the character wherein the back-up and grooving roll supports are relatively displaced through the use of a feed screw is provided with features which improve the strength and life of the feed screw while easing wear thereof and increasing the torque capabilities thereof, thus promoting the ability to groove thick wall pipe. In part in this respect, the feed screw is pivotally interconnected at its opposite ends with the two roll supports and, thus, is direct acting with respect to the application of force on the feed screw in a manner which minimizes or eliminates side thrust encountered in connection with the use of some of the feed screw arrangements heretofore available. Another improvement in connection with the feed screw arrangement is a release mechanism by which one of the two support members is released for displacement relative to the feed screw in response to an impact such as that resulting from dropping the apparatus. With such apparatus heretofore available, the force of such impact is imposed directly on the threads of the feed screw and cooperatively threaded portions of the roll grooving apparatus, thus imposing wear and/or damage resulting in difficulty in rotating the screw, increased maintenance and replacement costs, and/or shortening of the useful life of the feed screw component.

In accordance with another aspect of the invention, improved tracking is achieved through the provision of one or more features relating to the structures of the back-up or drive roll and the grooving roll and the support of the two rolls in connection with the performing of roll grooving operations. More particularly in this respect, the back-up or drive roll is provided with a knurling arrangement which minimizes twisting of a pipe relative to the back-up and grooving rolls during a roll grooving operation. Another feature with respect to improving tracking resides in supporting the grooving roll for the axis thereof to be at a fixed angle to the axis of the back-up roll and, in connection with the roll grooving of certain pipe, providing a taper on the grooving projection of the grooving roll which promotes relative axial displacement of a pipe and the grooving rolls inwardly of one another during a roll grooving operation. Yet another feature in connection with improving tracking in accordance with the invention is the provision of a support for the axially outer end of the back-up roll to minimize deflection of the latter during roll grooving operations which involve the application of heavy forces against the back-up roll and which deflection precludes maintaining proper orientation or alignment between the two rolls and a pipe therebetween and, thus, loss of the desired tracking. The latter support feature also advantageously enables one basic roll grooving unit to handle a full range of pipe sizes from 1¼ inch to 12 inch diameter pipe, for example, whereas two or more different units were required heretofore to accommodate the roll grooving of such a full range of pipe sizes.

It is accordingly an outstanding object of the present invention to provide roll grooving apparatus of the character including a feed screw for relatively displacing the grooving and back-up rolls of the apparatus with improvements with respect to the application of forces against the feed screw during roll grooving operations.

Another object is the provision of roll grooving apparatus of the foregoing character with a feed screw arrangement which reduces wear of the screw, reduces jamming and reduces the required input torque in connection with roll grooving and improves the strength and longevity of the screw while enabling the roll grooving of thick wall pipe.

Yet another object is the provision of roll grooving apparatus of the foregoing character with an impact actuated release arrangement for protecting the feed screw and cooperatively threaded portions of the apparatus from damage resulting from an impact axially against the feed screw.

A further object is the provision of roll grooving apparatus with improved self-tracking capabilities.

Yet a further object is the provision of a back-up roll for roll grooving apparatus with a knurling arrangement for promoting tracking while minimizing the cost of achieving the same.

Still a further object is the provision of a grooving roll structure having improved self-tracking capability.

Another object is the provision of a grooving roll mounting arrangement providing improved self-tracking capabilities in roll grooving apparatus.

A further object is the provision of roll grooving apparatus with an arrangement for supporting the axially outer end of the back-up or drive roll against deflection resulting from the application of high roll grooving forces thereagainst.

Still a further object is the provision of a roll grooving unit capable of roll grooving a larger range of pipe sizes than possible with apparatus heretofore available.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
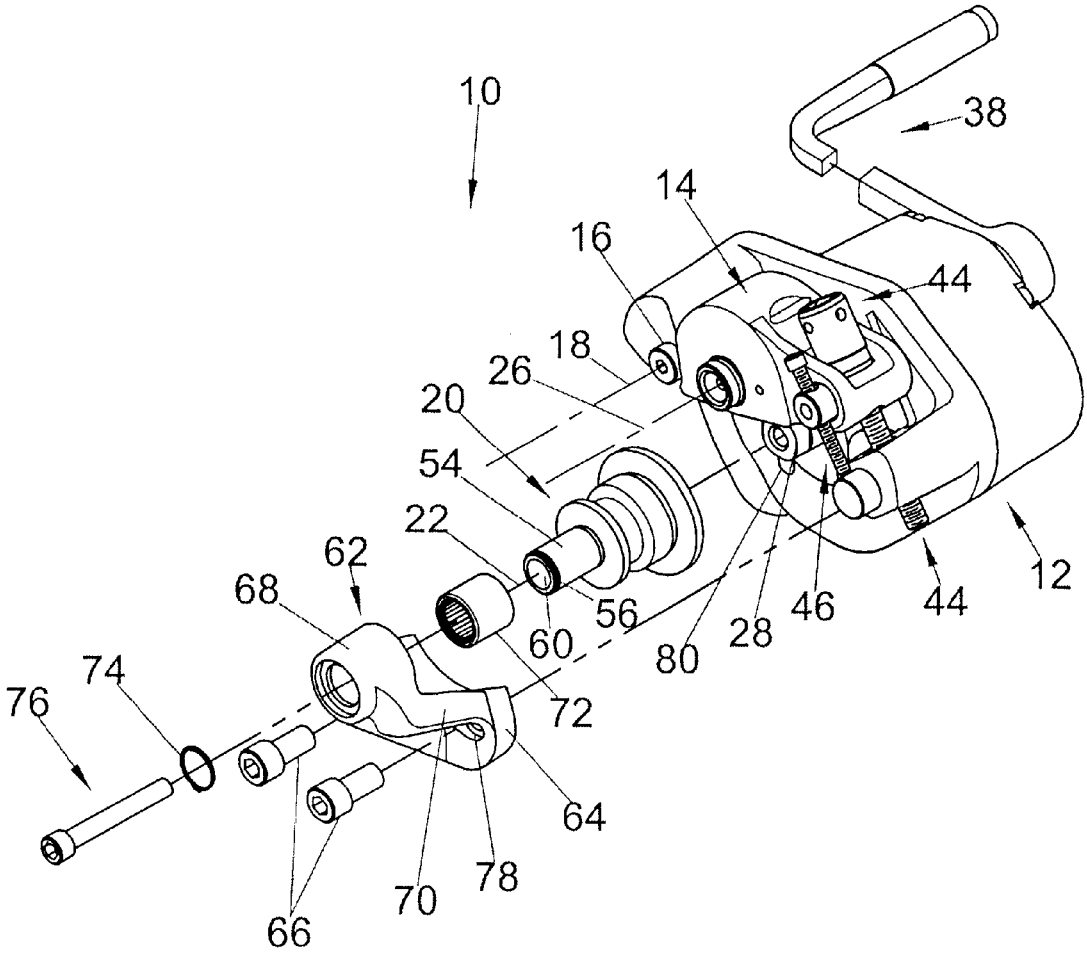
FIG. 1 is an exploded perspective view of roll grooving apparatus in accordance with the present invention.

Referring now in greater detail to the drawings, wherein the showings are for the purpose of illustrating preferred embodiments of the invention only, and not for the purpose of limiting the invention, FIGS. 1–4 illustrate roll grooving apparatus 10 which comprises a first support in the form of a housing 12 and a second support in the form of an arm 14 mounted on housing 12 by means of a pivot pin 16 for pivotal displacement in opposite directions about a pivot axis 18. Housing 12 supports a back-up or drive roll 20 for rotation about a roll axis 22 parallel to pivot axis 18, and arm 14 supports an idler or grooving roll 24 for rotation about a roll axis 26. In accordance with one aspect of the present invention, as described more fully hereinafter, roll axis 26 is fixed relative to arm 14 and is at a slight angle to roll axis 22. Rolls 20 and 24 are adapted to receive the wall of a pipe P therebetween and, as described in greater detail hereinafter, respectively provide female and male grooving rolls cooperable to roll a peripheral groove in pipe P in response to relative rotation between the rolls and pipe and radial displacement of roll 24 toward roll 20 during such relative rotation.

In the embodiment illustrated in FIGS. 1–4, back-up or drive roll 20 is adapted to be driven about axis 22 and, for this purpose and in the manner set forth more fully hereinafter, it is mounted on the axially outer end 28 of a drive shaft 30 which extends through housing 12 and is rotatably supported adjacent the front and rear ends of the housing by suitable bearings 32 and 34, respectively. Drive shaft 30 carries a drive gear 36 which is suitably secured thereto against rotation relative thereto, and gear 36 and thus drive shaft 30 is adapted to be rotated by means of a crank 38 through a pinion and gear reduction arrangement, not shown. Thus, it will be appreciated that manual rotation of crank 38 results in rotation of drive shaft 30 and back-up roll 20 and, as will be described in greater detail hereinafter, the rotation of drive roll 20 with pipe P interposed between the latter and roll 24 during a roll grooving operation causes apparatus 10 to travel about the periphery of the pipe as the groove is rolled therein.

Figure 3:
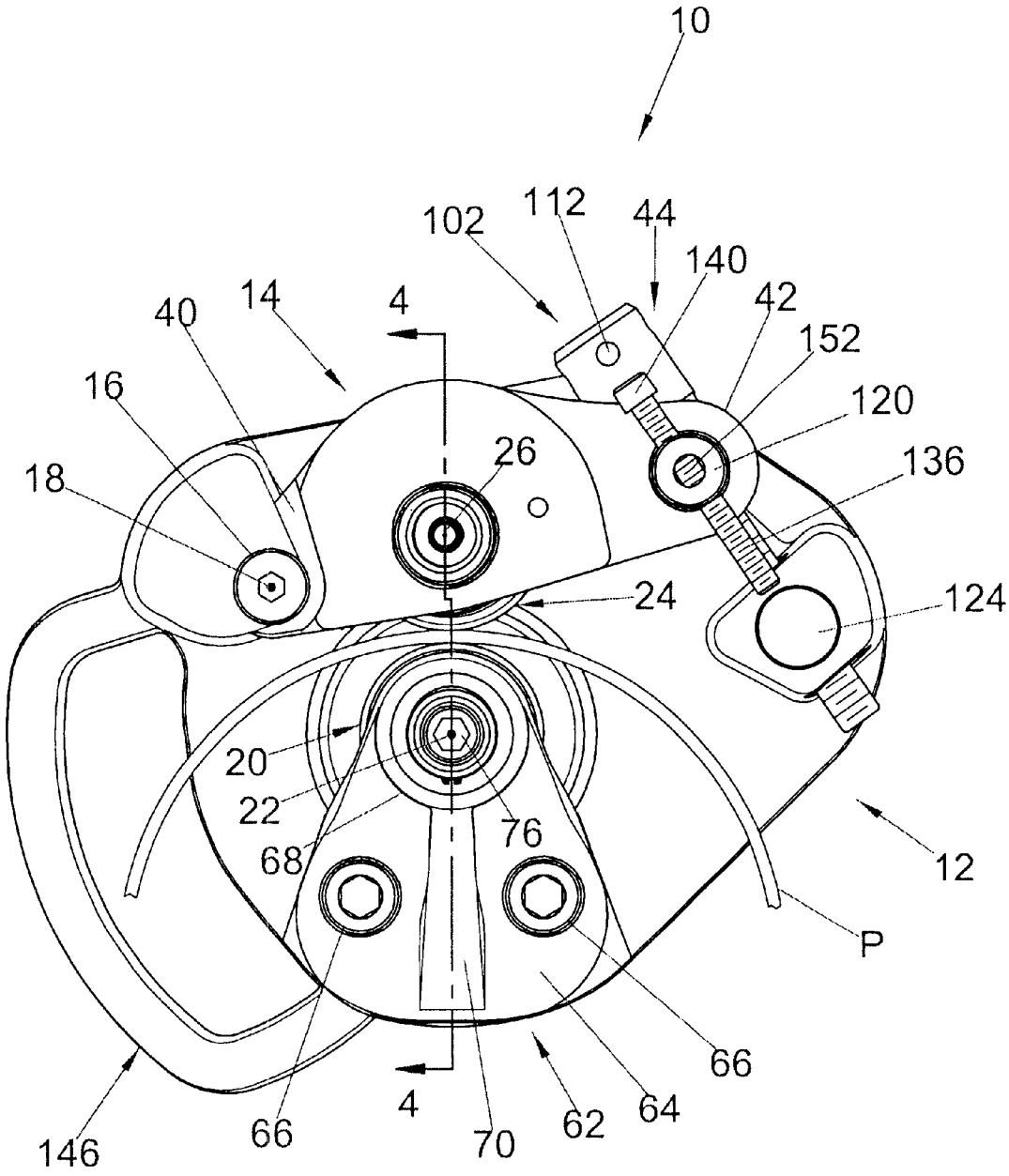
FIG. 3 is a front elevation view of the roll grooving apparatus shown in FIG. 2 and showing a pipe to be grooved between the drive and grooving rolls.

As best seen in FIG. 3, reaction arm 14 has a first end 40 pivotally secured to housing 12 by pin 16 such that pivot axis 18 is above and laterally offset to one side of roll axis 22. The arm extends laterally across housing 12 and roll axis 22 and has a second end 42 laterally offset from roll axis 22 on the side thereof opposite that of pivot axis 18. As described in detail hereinafter, end 42 of arm 14 is interconnected with housing 12 through a feed screw mechanism 44 by which the reaction arm is pivoted in opposite directions about axis 18 so as to displace grooving roll 24 radially toward and away from drive roll 20 and end 42 of the reaction arm further carries an adjusting screw 46 for limiting displacement of the arm and thus grooving roll 24 toward back-up roll 20 to provide a desired diameter of a groove being rolled in pipe P.

Figure 4:
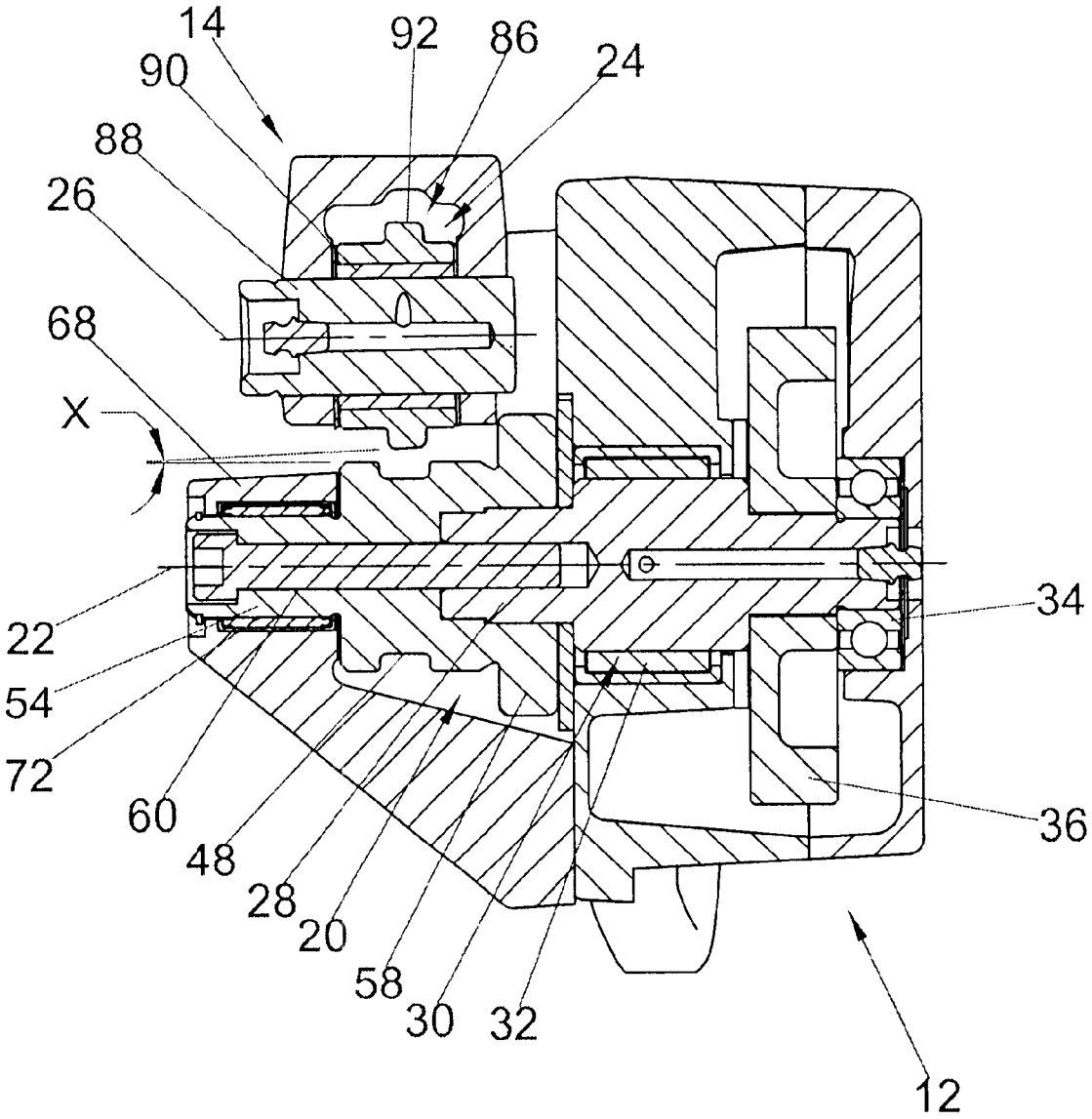
FIG. 4 is a cross-sectional elevational view through the back-up and grooving rolls taken along line 4—4 in FIG. 3.
Figure 7:
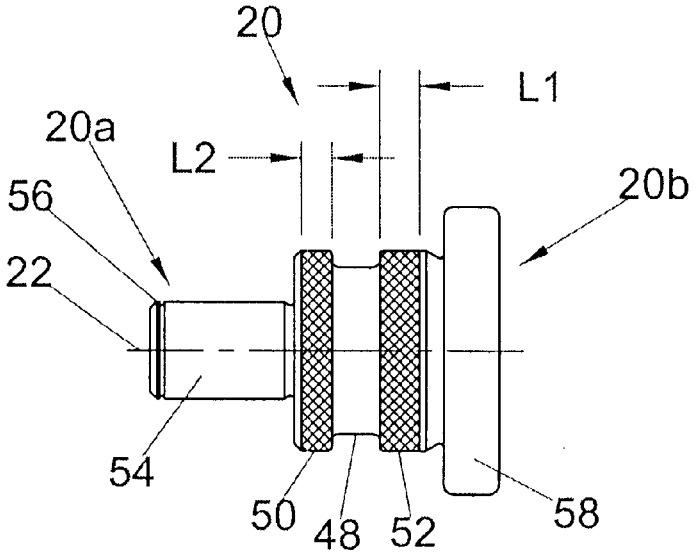
FIG. 7 is a side elevation view of a back-up or drive roll in accordance with the present invention.

In the embodiment illustrated in FIGS. 1–4, back-up or drive roll 20, which is also shown in FIG. 7, has axially outer and inner ends 20*a* and 20*b*, respectively, and a circular outer surface which includes a first portion providing a peripheral recess 48 and a second portion defined by surfaces 50 and 52 which are axially outwardly and axially inwardly adjacent recess 48, respectively. Outer end 20*a* of roll 20 is defined by a support shaft portion 54 having a spring clip recess 56 therein for the purpose set forth hereinafter, and inner end 20*b* of the roll is preferably defined by a circular flange 58 extending radially outwardly of surfaces 50 and 52 to provide an abutment for positioning a pipe P to be grooved relative to the grooving rolls during a roll grooving operation. Further in accordance with this embodiment, as best seen in FIGS. 1 and 4, roll 20 has an axial bore 60 therethrough and the support for the roll is provided by the axially outer end 28 of drive shaft 30 which is received in the inner end of bore 60 in roll 20 and a support member 62 which is removably mounted on housing 12 to support the outer end of the roll. More particularly in this respect, support member 62 includes a base portion 64 by which the support member is removably mounted on the front wall of housing 12 through the use of a pair of socket cap screws 66, a sleeve portion 68 and a bridging portion 70 by which the sleeve portion is supported axially outwardly of housing 12 and coaxial with roll axis 22. Sleeve portion 68 is adapted to receive and rotatably support shaft portion 54 of roll 20, preferably with a bearing sleeve 72 interposed therebetween. Such support limits deflection of roll axis 22 in response to the imposition of high forces against backup roll 20 during a roll grooving operation. Without such support for the axially outer end of roll 20, such deflection would likely occur in connection the roll grooving of 4 inch Sch. 40 to 12 inch Sch. 10 pipe using component parts of the roll grooving apparatus sized to handle 1¼ inch to 3½ inch Sch. 40 pipe. Thus, the use of support member 68 and the structure of back-up roll 20 for the axially outer end thereof to be supported by the support member enables a single roll grooving base unit to handle a full range of pipe sizes from 1¼ inch to 12 inch. As will become apparent hereinafter, support member 62 is adapted to be removed from housing 12 and back-up roll 20 replaced with a similar roll without support shaft portion 54, whereby the apparatus is then operable in connection with the rolling of grooves in the thinner wall pipes from 1¼ inch to 3½ inch Sch. 40.

It will be appreciated that the support of roll 20 against the deflection of roll axis 22 as described hereinabove promotes the desired tracking in conjunction with the rolling of grooves in thick wall pipe. With respect to the mounting of support member 62 and roll 20 on housing 12, roll 20 is first assembled with the support member by introducing support shaft portion 54 through bearing sleeve 72 and sleeve portion 68 and axially interengaging the latter components through the use of a spring clip 74 which is received in recess 56 in the axially outer end of support shaft portion 54. The axially inner end of roll 20 is then introduced onto outer end 28 of drive shaft 30 and the drive roll is secured to drive shaft 30 by a socket cap screw 76 which extends through bore 60 and into threaded interengagement with outer end 28 of drive shaft 30. Cap screws 66 are then introduced through openings 78 therefor in base portion 64 of the support member and into threaded openings 80 provided therefor in the front wall of housing 12 to securely mount support member 62 on the housing.

As mentioned above, and as will be appreciated from FIGS. 5, 8 and 10 of the drawing, when support member 62 and roll 20 are removed from housing 12 a similar back-up roll designated 20A in the latter figures can be mounted on the axially outer end 28 of drive shaft 30 to accommodate the roll grooving thin wall pipe. As will be appreciated from the description hereinabove, roll 20A has an axial bore, not shown, for receiving outer end 28 of shaft 30, and the roll is secured to the shaft by a socket cap screw similar to but shorter than screw 76 by which roll 20 is secured to the drive shaft.

Figure 9:
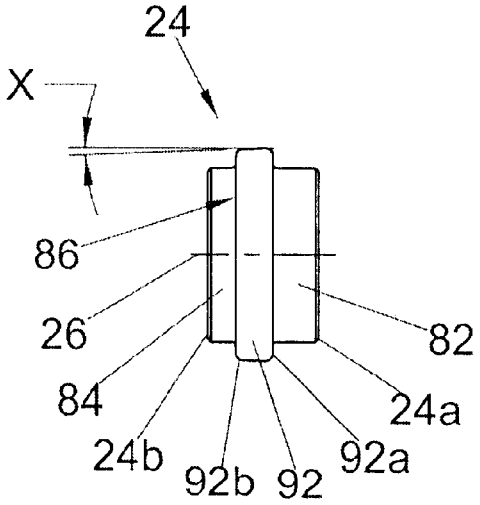
FIG. 9 is a side elevation view of a grooving roll in accordance with the present invention; and, FIG. 10 is a cross-sectional view through the back-up and grooving rolls taken along line 10—10 in FIG. 5.

As will be appreciated from FIGS. 4 and 9 of the drawing, idler or grooving roll 24 is of a mating contour with respect to back-up roll 20 and, accordingly, includes axially outer and inner ends 24*a* and 24*b*, respectively, circular outer surface portions 82 and 84 respectively overlying surface portions 50 and 52 of roll 20 and 50*a* and 52*a* of roll 20A, and a radially outwardly extending circular rolling projection 86 between surfaces 82 and 84 and overlying recess 48 of roll 20 or recess 48*a* of roll 20A. Grooving roll 24 is mounted on reaction arm 14 for rotation relative thereto by means of a pin or shaft component 88 and a bearing component 90 interposed between the shaft and grooving roll. In accordance with another aspect of the invention, rolling projection 86 includes an outer rolling surface 92 having axially inner and outer ends 92*a* and 92*b*, respectively. For most roll grooving operations, surface 92 is parallel to axis 26 of the grooving roll. However, in connection with the roll grooving of 4 inch-6 inch Sch. 40 pipe, surface 92 is tapered at an angle x relative to axis 26 so as to converge relative to the axis in the direction from outer end 92*a* toward inner end 92*b*. The taper preferably is 2° and, as will be appreciated from the structural relationship between grooving roll projection 86 and back-up roll recess 48 shown in FIG. 4, when projection 86 engages the outer side of a pipe interposed between the grooving and back-up rolls, tapered surface 92 biases the pipe axially inwardly against flange 58 of the back-up roll to promote the desired tracking. The taper on the rolling surface of the grooving roll also compensates for any bending deflection which may occur through the application of high forces in the roll grooving of thick wall pipe.

Figure 8:
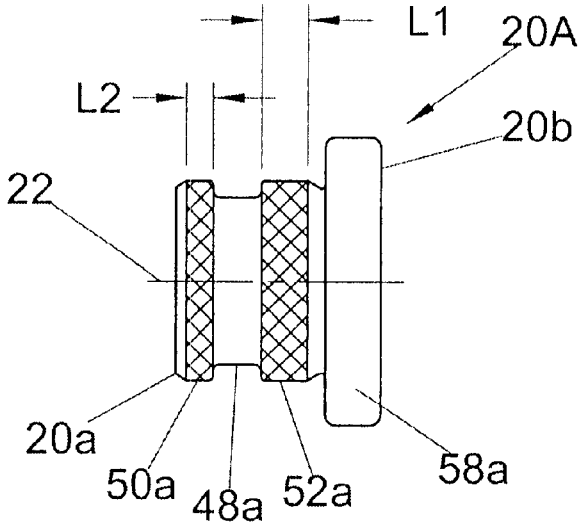
FIG. 8 is a side elevation view of another back-up or drive roll in accordance with the invention.

In accordance with another aspect of the invention, as shown in FIGS. 7 and 8, surface portions 50 and 52 of back-up roll 20 and surface portions 50*a* and 52*a* of roll 20A are provided with teeth, preferably in the form of diamond knurling, and the axially inner and outer surfaces relative to the inner end of the corresponding roll have an axial length L1 and L2, respectively. The length L2 is less than the length L1 for the purpose of precluding misalignment of a pipe being roll grooved relative to the grooving rolls during the initial phase of a roll grooving operation. More particularly in this respect, when the grooving roll initially engages against a pipe to be roll grooved and the material of the pipe is displaced into the groove or recess in the back-up roll, the portion of the pipe overlying surface portion 52 or 52*a* tends to flare radially outwardly from the surface, thus decreasing the area of contact between the roll surface and the pipe. Accordingly, if the length L2 initially is equal to the length L1 twisting or misalignment is promoted by the loss of contact between the pipe and surface 52 or 52*a*. Therefore, by making the length L2 less than the length L1, the flaring leaves the area of engagement between surfaces 50 and 52 or 50*a* and 52*a* and the pipe equal to one another, whereby misalignment is minimized or eliminated and tracking is improved. While diamond knurling is preferred, it will be appreciated that other tooth configurations can be provided. In connection with the roll grooving of a full range of pipe sizes from 1¼ inch to 12 inch, the length L1 is a minimum length that is necessary to preclude slippage or misalignment between the back-up roll and the pipe being roll grooved and, as an example, L1 is in the range from 0.354 inch to 0.383 inch. Further, as an example with regard to the various pipe sizes, length L1 for the back-up roll for roll grooving 1¼ inch to 1½ inch Sch. 10 and Sch. 40 steel is 0.380 inch; for 2 inch to 6 inch Sch. 10 and 2 inch to 3½ inch Sch. 40 steel is 0.358 inch; for 4 inch to 6 inch Sch. 40 steel is 0.354 inch; for 8 inch to 12 inch Sch. 10 steel is 0.383 inch; and for 2 inch to 8 inch copper is 0.358 inch. Lengths L1 & L2, and especially L1, are determined in party by the geometry of the groove form and, preferably, L1 is as long as possible and L2 as short as possible within geometric and functional limits. Accordingly, it will be appreciated that dimensional relationships different from the foregoing can be developed for achieving the desired control with respect to misalignment.

Figure 5:
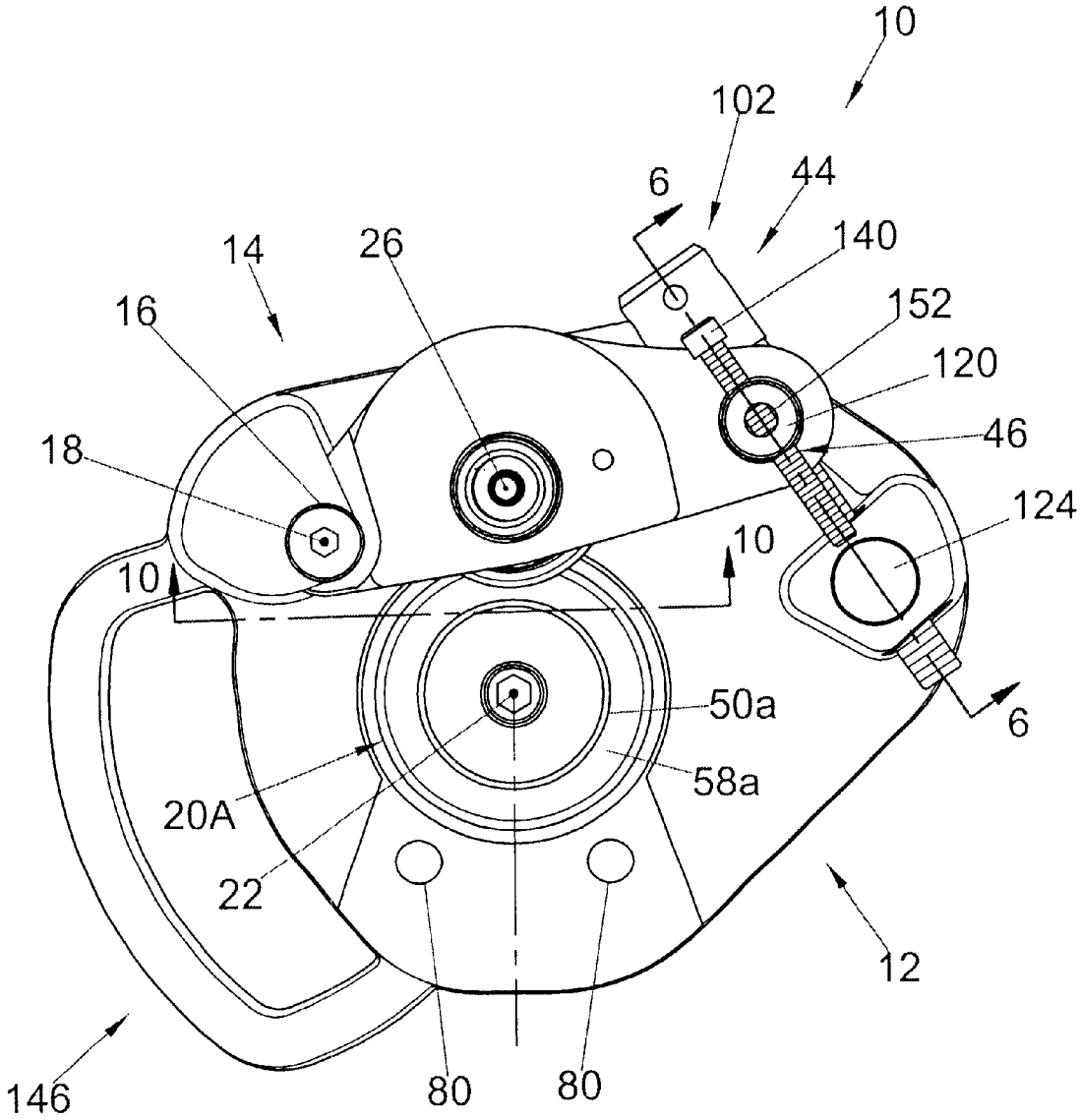
FIG. 5 is a front election view of the roll grooving apparatus with the support for the outer end of the drive roll removed and with another embodiment of a drive roll in accordance with the invention.
Figure 10:
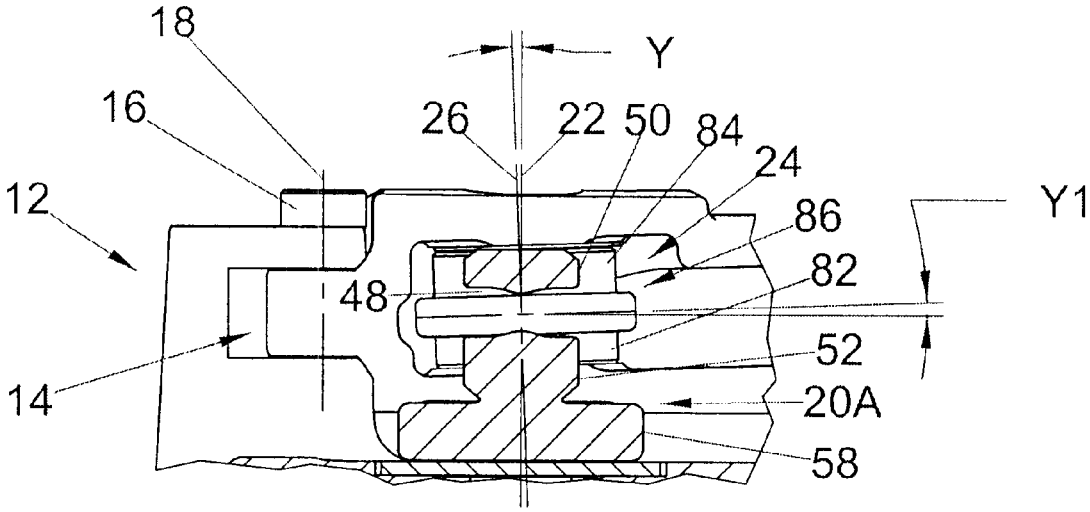

In accordance with yet another aspect of the invention, as shown in FIG. 10, the grooving rolls 24 for the full range of pipe sizes to be roll grooved are mounted on reaction arm 14 such that axis 26 of the grooving roll is at an angle y to axis 22 of the back-up roll in a plane which is transverse to a reference plane through axis 22 of the back-up roll and which reference plane is vertical in the orientation of the component parts shown in FIGS. 3 and 5 of the drawing. As will be further appreciated from FIG. 10, the angle y provides for rolling projection 86 of the grooving roll to be at the same angle y1 relative to rolling groove 48 of back-up roll 20. The angle y can be from 1° to 2° and, preferably is 2°. The angle of the axis of the grooving roll relative to the axis of the back-up roll in the transverse and reformer plane relationship referred to above promotes better tracking.

Each of the features described above, namely the provision of different length knurling surfaces, the taper on the rolling surface of the grooving roll and the grooving roll mounting at an angle to the back-up roll axis will function individually, to some extent, to improve alignment and tracking. However, optimum results are realized when the knurling and grooving roll mounting features are combined with respect to roll grooving the full range of pipe sizes referred to hereinabove and, in addition thereto, through the use of the support for the outer end of the back-up roll in conjunction with roll grooving heavy wall pipe, and through the use of a grooving roll having a tapered rolling surface in conjunction with roll grooving 4 inch-6 inch Sch. 40 pipe.

Figure 2:
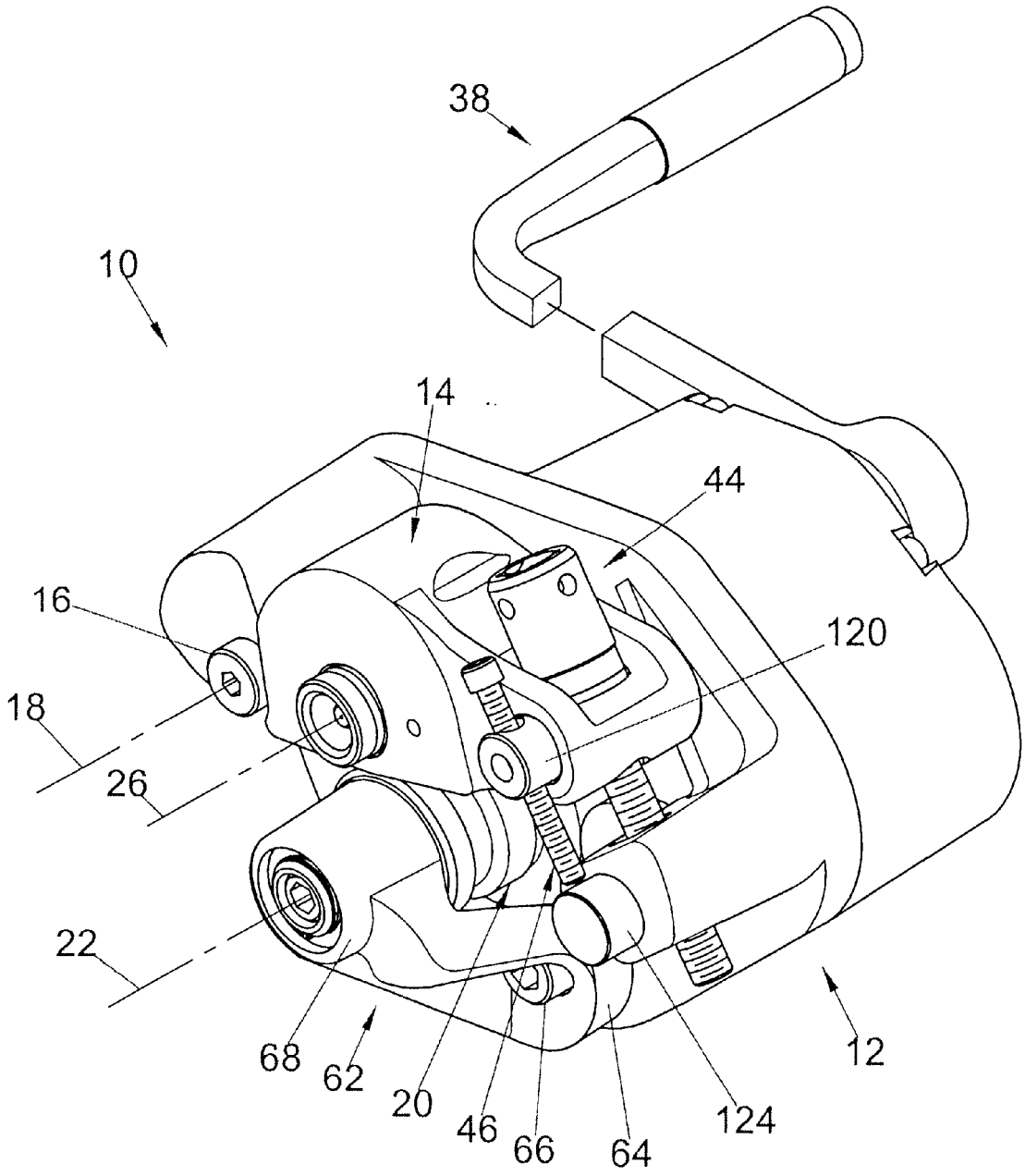
FIG. 2 is a perspective view of the assembled components shown in FIG. 1.
Figure 6:
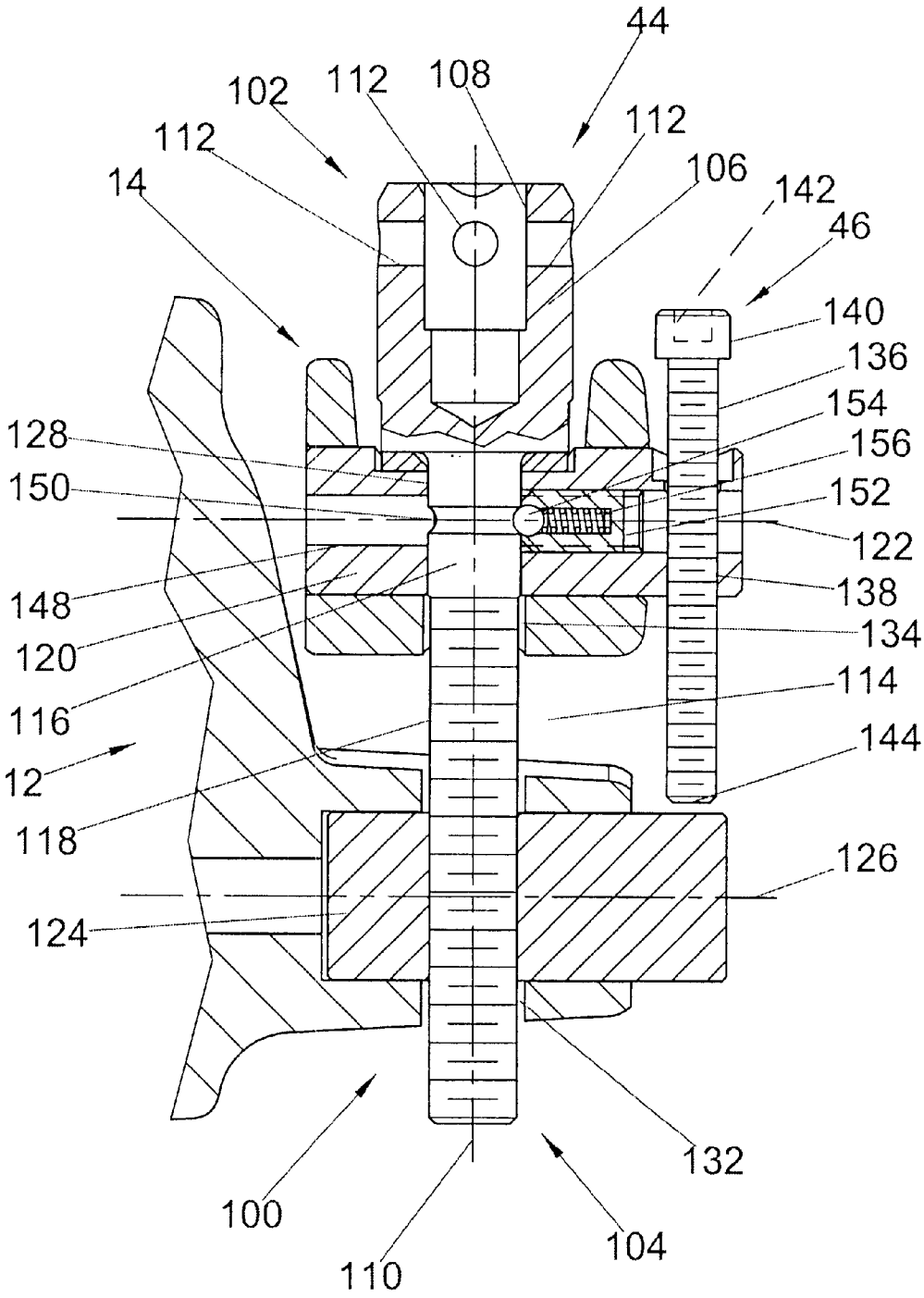
FIG. 6 is a cross-sectional elevational view of the feed screw and groove depth adjusting screw of the apparatus taken along line 6—6 in FIG. 5.

In accordance with still another aspect of the present invention, as best seen in FIGS. 2 and 6, feed screw mechanism 44 referred to hereinabove is structured and structurally interrelated with housing 12 and reaction arm 14 so as to preclude the imposition of side thrust on the feed screw during a roll grooving operation and to protect the feed screw component from damage resulting from an impact thereagainst resulting, for example, from dropping the roll grooving apparatus. More particularly in this respect, the feed screw mechanism comprises a feed screw member 100 having upper and lower ends 102 and 104, respectively, in the orientation of the apparatus shown in FIG. 4 of the drawing. Upper end 102 includes a tool head 106 having a non-circular opening 108 extending axially thereinto for receiving a suitable tool such as a ratchet wrench by which the feed screw is rotatable about the feed screw axis 110. Tool head 106 further includes pairs of diametrically opposed openings 112 therethrough for receiving the ball detent of a ratchet wrench to secure the latter to the feed screw. Feed screw 100 further includes a shank portion 114 extending axially from the inner end of tool head 106 to lower end 104 of the feed screw, and shank 114 includes an unthreaded shank portion 116 extending axially downwardly from tool head 106 and a threaded shank portion 118 extending from shank portion 116 to lower end 104 of the feed screw. The upper end of feed screw 100 is pivotally mounted on reaction arm 14 by means of a pivot pin 120 having a pivot axis 122, and the lower end of the feed screw is pivotally interconnected with housing 12 by means of a pivot pin 124 having a pivot axis 126. Pivot pin 120 is provided with a bore 128 which extends transversely through the pinto receive and rotatably support unthreaded shank portion 116 of the feed screw, and pivot pin 124 is provided with a threaded bore 130 extending transversely therethrough to threadedly interengage with threaded shank portion 118 of the feed screw. Accordingly, it will be appreciated that rotation of the feed screw in opposite directions about axis 110 displaces reaction arm 14 toward and away from housing 12 and, thus, displaces grooving roll 24 radially toward and away from back-up roll 20. The ability of feed screw 100 to pivot relative to both housing 12 and reaction arm 14 advantageously eliminates the imposition of side thrust against the feed screw when the latter is rotated to displace grooving roll 24 into engagement with a pipe interposed between the grooving roll and back-up roll during a roll grooving operation. It will be appreciated, of course, that such pivotal movement of the feed screw is enabled by enlarged openings 132 and 134 in housing 12 and reaction arm 14, respectively, and through which the corresponding portions of the feed screw shank extend.

As mentioned hereinabove, depth adjusting screw 46 is adapted to limit the displacement of reaction arm 14 toward housing 12 and, thus, the displacement of grooving roll 24 toward back-up roll 20 which, accordingly, determines the depth of the groove rolled in a pipe and, thus, the diameter of the groove. For this purpose, adjusting screw 46 has a threaded shank 136 threadedly interengaged with a threaded bore 138 extending transversely through pivot pin 120 and a tool head 140 at the upper end of shank 136 and which is provided with a non-circular recess 142 for receiving an appropriate tool by which the adjusting screw is rotatable relative to pin 120. Lower end 144 of shank 136 overlies pivot pin 124 so as to engage therewith to limit displacement of the reaction arm toward housing 12. Accordingly, it will be appreciated that the initial spacing between end 144 and pin 124 in conjunction with the roll grooving of a given pipe is adjustable for determining the depth of the groove to be rolled in the pipe.

Housing 12 is provided with a handle 146 by which the roll grooving apparatus is adapted to be carried from one location to another and, generally, during such transportation the feed screw and adjusting screw are positioned relative to pivot pin 124 on housing 12 such that end 144 of the adjusting screw is considerably spaced from the pivot pin. In accordance with a further aspect of the invention, the feed screw and reaction arm are adapted to be relatively displaceable axially of the feed screw in response to an impact which, otherwise, would impose undesirable and potentially damaging forces on the threads of the feed screw and bore 130. More particularly in this respect, as shown in FIG. 6, pivot pin 120 is provided with a bore 148 axially therethrough and unthreaded portion 116 of the feed screw shank is provided with a circumferentially continuous arcuate recess 150 which is located in bore 148 when tool head 106 is engaged against pivot pin 120. The end of bore 148 extending into the axially outer end of pivot pin 120 is threaded to receive an externally threaded ball detent insert housing 152 which supports a detent ball 154 and a spring 156 by which the ball is biased axially of the pivot pin and into recess 150. It will be appreciated, therefore, that an impact downwardly on reaction arm 14 in FIGS. 2 and 6 will result in the displacement of detent ball 154 radially outwardly of recess 150 and thus the release of the reaction arm for axial displacement relative to the feed screw along shank 114 thereof to the limit determined by the spacing between adjusting screw end 144 and pivot pin 124. It will be further appreciated that such release between the reaction arm and feed screw protects the feed screw threads on shank portion 118 and the threads in bore 130 of the pivot pin from potential damage resulting from forcing the threads axially against one another.

While considerable emphasis has been placed herein on the structures of and the structural interrelationships between the component parts of preferred embodiments of the present invention, it will be appreciate that many changes can be made in the embodiments disclosed herein and that other embodiments can be devised without departing from the principals of the present invention. Accordingly, it is to be distinctly understood that the foregoing descriptive matter is to be interpreted merely as illustrative of the invention and not as a limitation.

Having thus described the invention, it is so claimed:

1. Roll grooving apparatus for rolling a groove in a pipe comprising, a drive roll, first support means supporting said drive roll for rotation about a drive roll axis, second support means mounted on said first support means for pivotal displacement about a pivot axis parallel to said drive roll axis, a grooving roll mounted on said second support means for rotation about a grooving roll axis, a feed screw member having a feed screw axis and axially opposite first and second ends respectively interengaged with said first and second support means for rotation of said screw member about said feed screw axis to displace said second support means and said grooving roll thereon about said pivot axis to displace said grooving roll radially toward and away from said drive roll, said second end of said screw member including means by which said screw member can be rotated, and said feed screw axis being inclined relative to a plane through said drive roll axis and said grooving roll axis such that said second end of said screw member is closer to said plane than said first end.

2. Apparatus according to claim 1, and means mounted on said second support means separate from said feed screw member for limiting the displacement of said grooving roll toward said drive roll.

3. Apparatus according to claim 2, wherein said means for limiting displacement of said grooving roll includes an adjusting screw having an adjusting screw axis, said adjusting screw being rotatable about said adjusting screw axis relative to said second support means for varying the limit of displacement of said grooving roll toward said drive roll.

4. Roll grooving apparatus for rolling a groove in a pipe comprising, a drive roll, first support means supporting said drive roll for rotation about a drive roll axis, second support means mounted on said first support means for pivotal displacement about a pivot axis parallel to said drive roll axis, a grooving roll mounted on said second support means for rotation about a grooving roll axis, a feed screw member having a feed screw axis and axially opposite first and second ends respectively interengaged with said first and second support means for rotation of said screw member about said feed screw axis to displace said second support means and said grooving roll thereon about said pivot axis to displace said grooving roll radially toward and away from said drive roll, said second end of said screw member including means by which said screw member can be rotated, said feed screw axis being inclined relative to a plane through said drive roll axis and said grooving roll axis such that said second end of said screw member is closer to said plane than said first end, means mounted on said second support means separate from said feed screw member for limiting the displacement of said grooving roll toward said drive roll, said means for limiting displacement of said grooving roll including an adjusting screw having an adjusting screw axis, said adjusting screw being rotatable about said adjusting screw axis relative to said second support means for varying the limit of displacement of said grooving roll toward said drive roll, said first end of said feed screw member being pivotally interengaged with said first support means by a pin member pivotal about a pin axis transverse to said feed screw axis, and said adjusting screw having an end for engaging said pin member to limit the displacement of said grooving roll toward said drive roll.

5. Roll grooving apparatus for rolling a groove in a pipe comprising, a drive roll, first support means supporting said drive roll for rotation about a drive roll axis, second Support means mounted on said first support means for pivotal displacement about a pivot axis parallel to said drive roll axis, a grooving roll mounted on said second support means for rotation about a grooving roll axis, a feed screw member having a feed screw axis and axially opposite first and second ends respectively interengaged with said first and second support means for rotation of said screw member about said feed screw axis to displace said second support means and said grooving roll thereon about said pivot axis to displace said grooving roll radially toward and away from said drive roll, said second end of said screw member including means by which said screw member can be rotated, said feed screw axis being inclined relative to a plane through said drive roll axis and said grooving roll axis such that said second end of said screw member is closer to said plane than said first end, said first end of said feed screw member being pivotally interengaged with said first support means by a first pin member pivotal about a first pin axis transverse to said feed screw axis, and said second end of said feed screw member being pivotally interconnected with said second support means by a second pin member pivotal about a second pin axis parallel to said first pin axis.

6. Apparatus according to claim 5, wherein said first end of said feed screw member is threadedly interengaged with said first pin member and said second end of said feed screw member is interengaged with said second pin member for rotation relative thereto and against axial displacement relative thereto.

7. Apparatus according to claim 6, and means for releasing said second end of said feed screw member for axial sliding displacing of said second support means relative to said feed screw member.

8. Apparatus according to claim 7, wherein said means for releasing includes spring biased detent means between said second end of said feed screw member and said second support means.

9. Apparatus according to claim 8, wherein said detent means include a circumferential groove in said second end of said feed screw member, and a spring biased ball supported on said second support means for releasably engaging in said groove.

10. Apparatus according to claim 9, wherein said spring biased ball is supported in a passageway in said second pin member coaxial with said second pin axis.

11. Apparatus according to claim 8, and an adjusting screw mounted on said second support means separate from said feed screw and having an adjusting screw axis parallel to said feed screw axis, said adjusting screw being rotatable about said adjusting screw axis relative to said second support means and having an end for engaging said first support means to limit the displacement of said grooving roll toward said drive roll.

12. Apparatus according to claim 11, wherein said adjusting screw is threadedly interengaged with said second pin member and said end of said adjusting screw engages against said first pin member to limit the displacement of said grooving roll toward said drive roll.

13. Apparatus according to claim 12, wherein said detent means includes a circumferential groove in said second end of said feed screw member and a spring biased ball supported in a passageway in said second pin member coaxial with said second pin axis for releasably engaging in said groove.

14. Roll grooving apparatus for rolling a groove in a pipe comprising, a drive roll, first support means supporting said drive roll for rotation about a drive roll axis, second support means mounted on said first support means for pivotal displacement about a pivot axis parallel to said drive roll axis, a grooving roll mounted on said second support means for rotation about a grooving roll axis, feed screw means between said first and second support means for displacing said second support means and said grooving roll thereon about said pivot axis to displace said grooving roll radially toward and away from said drive roll, said feed screw means including a feed screw member having a feed screw axis and axially opposite first and second ends, said first end being threaded and in threaded interengagement with said first support means, said second end being cylindrical and interengaged with said second support means for rotation relative thereto about said feed screw axis and for sliding displacement of said second support means axially of said second end in the direction toward said first end, and means releasably interengaging said second end and said second support means against axial displacement in said direction.

15. Apparatus according to claim 14, wherein said means for releasing includes spring biased detent means between said second end of said feed screw member and said second support means.

16. Roll grooving apparatus for rolling a groove in a pipe comprising, a drive roll, first support means supporting said drive roll for rotation about a drive roll axis, second support means mounted on said first support means for pivotal displacement about a pivot axis parallel to said drive roll axis, a grooving roll mounted on said second support means for rotation about a grooving roll axis, feed screw means between said first and second support means for displacing said second support means and said grooving roll thereon about said pivot axis to displace said grooving roll radially toward and away from said drive roll, said feed screw means including a feed screw member having a feed screw axis and axially opposite first and second ends, said first end being threaded and in threaded interengagement with said first support means, said second end being cylindrical and interengaged with said second support means for rotation relative thereto about said feed screw axis and for sliding displacement of said second support means axially of said second end in the direction toward said first end, means including spring biased detent means between said second end of said feed screw member and said second support means for releasably interengaging said second end and said second support means against axial displacement in said direction, said detent means including a circumferential groove in said second end of said feed screw member, and a spring biased ball supported on said second support means for releasably engaging in said groove.

17. Apparatus according to claim 16, wherein said second end of said feed screw member is pivotally interconnected with said second support means by a pin member having a pin axis transverse to said screw axis and wherein said spring biased ball is supported in a passageway in said pin member coaxial with said pin axis.

18. Apparatus according to claim 16, and means mounted on said second support means separate from said feed screw member for limiting the displacement of said grooving roll toward said drive roll.

19. Apparatus according to claim 18, wherein said means for limiting displacement of said grooving roll includes an adjusting screw having an adjusting screw axis parallel to said feed screw axis, said adjusting screw being rotatable about said adjusting screw axis relative to said second support means for varying the limit of displacement of said grooving roll toward said drive roll.

20. Apparatus according to claim 19, wherein said first end of said feed screw member is pivotally interengaged with said first support means by a first pin member pivotal about a first pin axis transverse to said feed screw axis, said second end of said feed screw member being pivotally interconnected with said second support means by a second pin member pivotal about a second pin axis parallel to said first pin axis, said spring biased ball being supported in a passageway in said second pin member coaxial with said second pin axis, and said adjusting screw having an end for engaging said first pin member to limit displacement of said grooving roll toward said drive roll.

21. Apparatus according to claim 16, wherein said first end of said feed screw member is pivotally interengaged with said first support means by a first pin member pivotal about a first pin axis transverse to said feed screw axis, said second end of said feed screw member being pivotally interconnected with said second support means by a second pin member pivotal about a second pin axis parallel to said first pin axis.

22. Apparatus according to claim 21, wherein said first end of said feed screw member is threadedly interengaged with said first pin member and said second end of said feed screw member is interengaged with said second pin member for rotation relative thereto and against axial displacement relative thereto.

23. Apparatus according to claim 22, wherein said spring biased ball is supported in a passageway in said second pin member coaxial with said second pin axis.

* * * * *

UNITED STATES PATENT AND TRADEMARK OFFICE

CERTIFICATE OF CORRECTION

PATENT NO. : 6,606,893 B2
DATED : August 19, 2003
INVENTOR(S) : James E. Hamm and Randy Scott Wise It is certified that error appears in the above-identified patent and that said Letters Patent is hereby corrected as shown below:

Column 7,
Line 36, change “party” to -- part --.

Column 9,
Line 41, change “appreciate” to -- appreciated --.

Column 10,
Line 49, change “Support” to -- support --.

Signed and Sealed this

Fourteenth Day of October, 2003

JAMES E. ROGAN
*Director of the United States Patent and Trademark Office*